US005383980A

United States Patent [19]

Melber et al.

[11] Patent Number: 5,383,980

[45] Date of Patent: Jan. 24, 1995

[54] PROCESS FOR HARDENING WORKPIECES IN A PULSED PLASMA DISCHARGE

[75] Inventors: Albrecht Melber, Darmstadt; Kyong-Tschong Rie; Frank Schnatbaum, both of Braunschweig, all of Germany

[73] Assignee: Leybold Durferrit GmbH, Cologne, Germany

[21] Appl. No.: 54,847

[22] Filed: Apr. 29, 1993

Related U.S. Application Data

[63] Continuation-in-part of Ser. No. 918,668, Jul. 22, 1992, abandoned.

[30] Foreign Application Priority Data

Jan. 20, 1992 [DE] Germany ..... 4201325
Nov. 19, 1992 [DE] Germany ..... 4238993

[51] Int. Cl.[6] ..... C23C 8/22
[52] U.S. Cl. ..... 148/222; 148/235; 204/164; 219/121.58; 219/121.59
[58] Field of Search ..... 148/222, 235; 204/164; 219/121.58, 121.59

[56] References Cited

U.S. PATENT DOCUMENTS 4,762,756 8/1988 Bergmann et al. ..... 204/192.12
4,853,046 8/1989 Verhoff et al. ..... 148/222

FOREIGN PATENT DOCUMENTS 4-136153 5/1992 Japan ..... 148/222

OTHER PUBLICATIONS

Grube, W. L. and Gay, J. G., High-Rate Carburizing in a Glow-Discharge Methane Plasma, Metallurgical Transactions A vol. 9A, Oct. 1978, 1421-1429.

*Primary Examiner*—Richard O. Dean
*Assistant Examiner*—Sikyin Ip
*Attorney, Agent, or Firm*—Felfe & Lynch

[57] ABSTRACT

Workpieces of steel are hardened by carburizing the surface and then quenching. The carburizing is performed by means of a plasma discharge in a vacuum, in the presence of gaseous hydrocarbons at voltages between 200 and 2000 volts, preferably between 300 and 1000 volts, and preferably with the admixture of argon. The plasma is produced by means of electrodes operated in a vacuum, the cathode of which serves as workpiece holder and is operated by pulsed operation. In order to achieve a uniform hardness distribution and to reduce the mass flow of carbon, even in the case of irregularly shaped workpieces, the carburization is performed at a total pressure between 14 and 30 mbar, the pulse duration is selected between 110 and 10,000 μsec, and the pause duration is selected between 30 and 10,000 μsec. After the start-up phase has ended, the average power fed to the plasma discharge is reduced either continuously or step-wise by shortening the pulse duration and/or by prolonging the pulse duration, such that, without interruption of the pulsed operation, the carbon content at the surface of the workpiece will at no time exceed the carbon saturation limit of the steel in the austenite region.

12 Claims, 4 Drawing Sheets

PROCESS FOR HARDENING WORKPIECES IN A PULSED PLASMA DISCHARGE

This application is a continuation-in-part of U.S. application Ser. No. 07/918,668 filed Jul. 22, 1992, now abandoned.

BACKGROUND OF THE INVENTION

The invention relates to a process for hardening workpieces of steel, especially those having at least one alloy element from the group Cr, Ni, Mn, Si and Mo by carburizing the surface and then quenching. The carburizing is performed by a plasma discharge in a vacuum in the presence of gaseous hydrocarbons at partial pressures between 1 and 20 mbar (100 to 2000 Pa) and at voltages between 200 and 2000 volts, preferably between 300 and 1000 volts. The plasma is produced by means of electrodes operated in a vacuum, the cathode serving as workpiece holder and being operated in pulsed mode.

U.S. Pat. No. 4,881,982 discloses that if the rate of delivery (mass flow $m_c$) of the carbon to the workpiece surface is too high, carbon supersaturation occurs which results in the formation of carbides. This drastically lowers the high hardness already achieved by the carburization. Ideally, the carbon content and hardness characteristic should be able to be represented in a diagram as approximately S-shaped curves.

Reducing the supersaturation by diffusing carbon into the depth of the workpiece would only be possible by extremely lengthy diffusion processes. It is therefore proposed in the literature to cycle back and forth repeatedly between the carburizing phase and the diffusion phase so as to give the carbon the chance to diffuse to the necessary depth in the workpiece. The cycle times are long and the determination of the time at which to cycle is difficult and therefore inaccurate.

U.S. Pat. No. 4,900,371 discloses a pulsed plasma process of the kind described above in which the repetition time is 10 milliseconds and the pulse and pause times amount each to 5 ms. The parameters stated are said to result in making the gas and plasma distribution over the workpiece surface uniform, but at the usual cathode voltages of 500 to 1000 V, mass flows of carbon result, which without the insertion of carburization-free diffusion phases, would within a few minutes lead to the supersaturation of the surface area with carbon and thus to the undesired formation of carbide. From the data given, a mass flow of carbon results, of $$m_c = \text{approx.}80\ \text{g m}^{-2}\ \text{h}^{-1}$$

A further problem lies in the fact that in plasma carburization the process is performed in the range of the so-called anomalous incandescent discharge, in which, in the event of an increase of the voltage from about 200 to over 1000 volts, the current density increases disproportionately until the anomalous discharge abruptly changes to an arc discharge after a limit voltage is exceeded (see: (1) Bell/Loh/Staines "Thermochemische Behandlung im Plasma," NEUE HÜTTE, vol 28, No. 10, October 1983, pages 373 to 379; (2) Booth/Farrell-/Johnson, "The Theory and Practice of Plasma Carburizing" HEAT TREATMENT OF METALS, 1983, pp. 45 to 52).

This process is to be avoided under all circumstances, since it would result in damage to the workpiece. Under the conditions of U.S. Pat. No. 4,900,371 a shift from the anomalous incandescent discharge to an arc discharge cannot be excluded with sufficient reliability.

U.S. Pat. No. 4,490,190, which corresponds to EP-B 062 550, discloses a process operated at constant power throughout its duration in which a pulse duration very much shorter than the duration of the period is selected in order to make two treatment parameters independent of one another, namely the plasma on the one hand and the treatment temperature on the other. This problem, however, exists only in the case of nitridation and carbonitridation, since the treatment temperatures in this case must be definitely below 600° C. Under the stated conditions, carburization is not possible within economically acceptable treatment times, since this process does not take place at a practical rate until the temperatures are above about 800° C.

SUMMARY OF THE INVENTION

The process according to the invention is conducted with a repeatable and simpler control such that, even in the case of irregularly shaped workpieces, a uniform hardness distribution will be achieved and carbide will not form at the surface without the interposition of a pronounced diffusion phase. The carbon content at the surface of the workpiece can be adjusted to any value between the carbon content of the core of the workpiece and the saturation limit of the material, and a shift from an incandescent discharge to an arc discharge is reliably prevented.

According to the invention:

a) the carburization is performed at a total pressure between 14 and 30 mbar (1400 to 3000 Pa), b) the pulse time is selected between 110 and 10,000 μs (microseconds), c) the pause time is selected between 30 and 10,000 μs, and that d) the average power delivered to the plasma discharge is reduced after the end of the start-up phase by reducing the pulse time and/or by lengthening the pause time, such that, without interruption of the pulsed operation, the carbon content at the surface will at no time exceed the saturation limit of the material for carbon in the austenite region.

Thus, with a simpler process control and management, carbide formation at the surface is prevented without the insertion of a pronounced diffusion phase. The carbon content at the surface of the work-piece can be adjusted repeatably to any level between the carbon content of the core in the workpiece and its saturation limit, and a shift from incandescent discharge to an arc discharge is reliably prevented.

At the same time the mass flow $m_c$ of the carbon is especially reduced, so that its solubility in the austenite is not exceeded and no carbides can be formed. The process of the invention can be operated in a quasi-stationary manner with a constantly pulsed plasma.

The oxidation-free carburization of the surface by the plasma results in an increase in the endurance limit, the distortion of the workpiece is reduced, and the cost of the further processing of the workpieces is lowered.

Particularly advantageous ratios of pulse time to pause time lie between 0.3 and 0.02. At a ratio of 0.2 the result was a mass flow of carbon of $$m_c = 30\ \text{g/m}^2/\text{h}$$

At the same time it is important to maintain feature d). If the ratio decreased to 0.025 the result was still a mass flow of $$m_c = 5\ g/m^2/h$$

It is especially advantageous if after a start-up phase with a very rapid increase of the carbon content at the surface, the average power is backed down before the saturation limit is reached. Pulsed operation at a lower average power level is continued with a continuous propagation of the carbon content below the saturation limit into the depth of the workpiece.

The mass flow is then just as great as the migration in the workpiece by diffusion. In this manner the process can be accelerated, i.e., the rate of carburization can be selected very high at the beginning, but after that it is adapted to the rate of diffusion.

The following embodiments of the method of the invention result in additional advantages:

(1) The reduction of the average power is performed continuously, or in one or more steps.

(2) In an additional step the mass flow $m_c$ is reduced or set at 0 to such an extent that, by additional diffusion from the surface into the interior of the workpiece, the marginal carbon content is lowered to the desired level and (if the hardening is represented by a curve) a horizontal line is established in the marginal area.

(3) The process gas fed to the plasma consists of 2 to 50%, preferably 10 to 30%, argon, 3 to 50%, preferably 10 to 30%, hydrocarbon gas, remainder hydrogen (percentages by volume).

(4) With increasing pressure in the process chamber, i.e., at the upper end of the pressure range, a better "fit" of the plasma to a contoured, textured or even undercut workpiece surface is achieved, as is the case, for example, with gears, bearing cages or the like.

By the addition of argon, a part of the energy input is used for the ionization of the argon, to the advantage of the process. Suitable hydrocarbon gases are methane, ethane, propane, ethylene and propene.

As a technical note, austenite for pure iron exists at 911° C. to 1392° C. However, the lower temperature limit for the austenite region decreases with increasing carbon content; the minimum austenite temperature of 723° C. occurs with a carbon content of 0.8%. The presence of alloying elements may also decrease the austenite temperature. The preferred temperature for carburizing is usually provided by manufacturer of the steel.

As a further technical note, the speed of carburizing increases with increasing temperature. However, at high temperatures (above 970° C.), grain growth increases, which is detrimental to steel quality. Accordingly, the carburization temperature should be kept well below 970° C.

DETAILED DESCRIPTION OF THE PREFERRED EMBODIMENT

Figure 1:
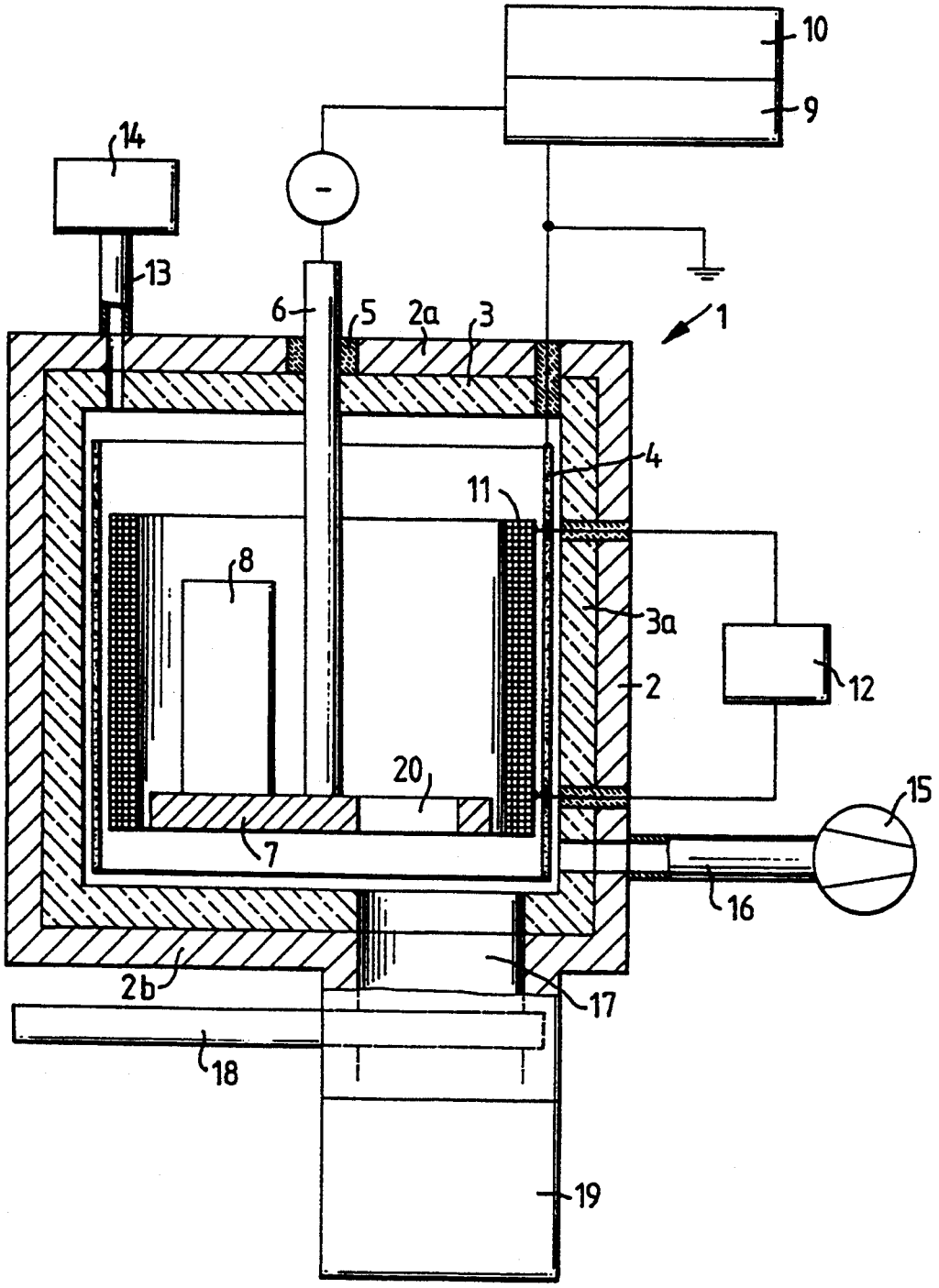
FIG. 1 shows a vertical section through an apparatus for performing the process according to the invention.

FIG. 1 shows a vacuum oven 1 with an oven chamber 2 which is lined with thermal insulation 3. In front of the side walls 3a of the insulation arrangement there is a grounded electrode which serves as the anode 4 of the circuit. A vertical hanger rod 6 passes through the oven roof 2a in an insulated lead-through 5 and bears at its bottom end a horizontal, plate-like workpiece holder which also serves as an electrode, i.e., as the cathode 7. Only one of the workpieces 8 disposed on this workpiece holder is represented.

Between the cathode 7 and the anode 4 there is a power supply 9 for producing the voltage pulses for the formation of the plasma. A controller 10 is associated with the power supply 9 permitting the adjustment of the electrical process parameters for controlling the plasma.

Cathode 7 and workpieces 8 are concentrically surrounded by a resistance heating body 11 which is connected to a controllable power source 12. The energy balance of the oven and with it the workpiece temperature is determined on the one hand by the losses and on the other hand by the sum of the energy contributions of the plasma and of the radiation of the resistance heating body.

A supply line 13 coming from a controllable gas source 14 leads into the oven chamber 2 and through it the desired process gases or gas mixtures are delivered. The gas balance is determined by the gas feed, by consumption of gas by the workpieces and, in some cases, by losses, and last but not least by the influence of the vacuum pump 15 which is connected by a vacuum line 16 to the oven chamber 2. This can also be configured as a set of pumps.

In the floor of the oven chamber 2 is an opening 17 which can be closed by a sliding valve 18 and under which a heated tank 19 containing quenching oil is hermetically attached. Over the opening 17 is an opening 20 in the cathode 7 through which the workpieces 8 can be lowered by a manipulator not shown into the quenching oil. The manner in which this apparatus is operated will appear from the general description and from the example.

Figure 2:
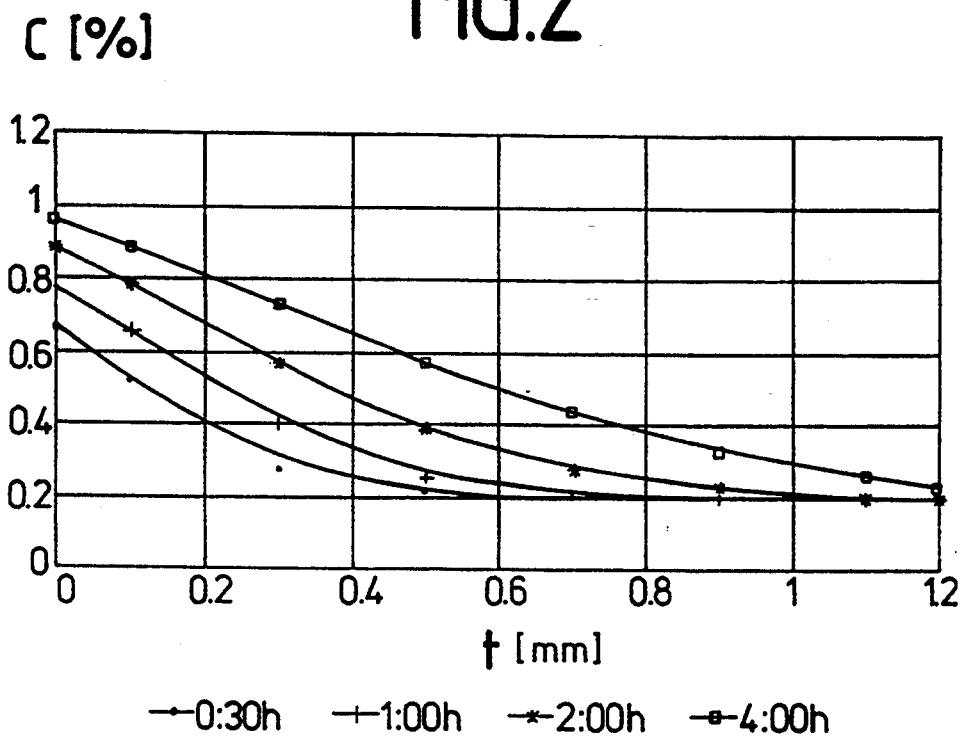
FIG. 2 is a parametric representation of the variation of the carbon concentration at various depths in the workpiece after different processing times.

FIG. 2 shows a parametric diagram of the variation of the carbon concentration at various depths in the workpiece after different process times, in a case where one of the methods of the state of the art (gas carburization) without interruption of the carburization by a diffusion pause is employed. On the abscissas are recorded the depths in millimeters starting from the workpiece surface, and on the ordinates the carbon concentration in percentages by weight. The individual curves apply (from bottom up) to the process times of 0.5, 1, 2 and 4 hours printed below the abscissas. It can be seen that the carbon concentration at the surface in the case of 2 hours of process time has already exceeded the saturation level, resulting in a loss of hardness seen in FIG. 3.

Figure 3:
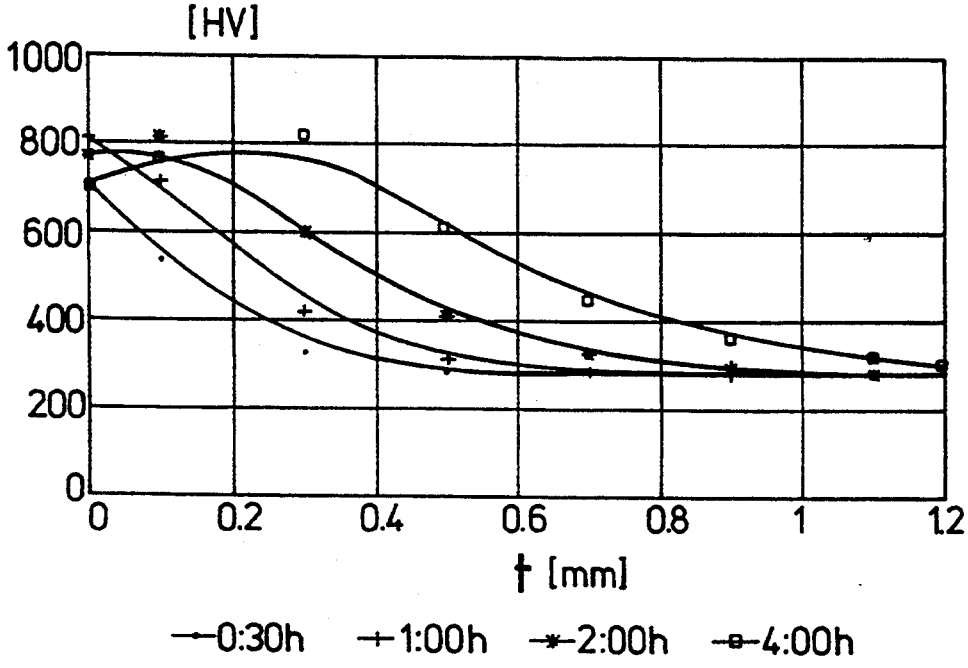
FIG. 3 shows the hardnesses pertaining to FIG. 2.

FIG. 3 shows the hardnesses pertaining to FIG. 2. The axis of abscissas bears the same scale, and the corresponding hardness values are recorded on the ordinates in HV. It is to be noted that the surface hardness after one hour reaches a peak value of 800 HV with a steep loss toward the depth, but that after a process time of 2 hours it begins to diminish again by the formation of carbide and after 4 hours it drops to about 700 HV. As the tests continue conditions worsen, as it is also generally known from the literature (e.g., U.S. Pat. No. 4,881,982).

EXAMPLE 1

In an apparatus according to FIG. 1, dowel pins of 16MnCr5 alloy steel with a diameter of 20 mm were carburized in batches. 16MnCr5 contains at the outset 0.16% C, 1.15% Mn, and 0.95% Cr. First the apparatus was evacuated to a pressure of $10^{-3}$ mbar to remove the residual gases, and then a mixture of 15% argon, balance hydrogen, was admitted up to a pressure of 15 mbar. By the simultaneous operation of the resistance heater and the application of a negative voltage of 600 V to the substrates, the latter were cleaned by sputtering and heated to 900° C. The pretreatment took 60 minutes. Then the gas atmosphere was replaced by one composed of 5% methane, 80% hydrogen and 15% argon, until a pressure of 15 mbar was reached. Then the actual carburization was performed by a pulsed operation in which the pulse voltage was set at the power source to 600 V, and the ratio of pulse time to pause time was set at 0.07. The first phase of the treatment time amounted in this case to 240 min, while the substrate temperature was maintained at a constant 900° C. by controlling the power of the resistance heater. After that the ratio was lowered to 0.023 at otherwise the same parameters and the carburization was continued for a period of 90 minutes while controlling the power of the resistance heater accordingly. At no time during the entire process did arc discharges occur. Then the dowel pins with their cylinder axes in the vertical position were introduced with a manipulator into the oil bath which was held at a temperature of 60° C.

Figure 4:
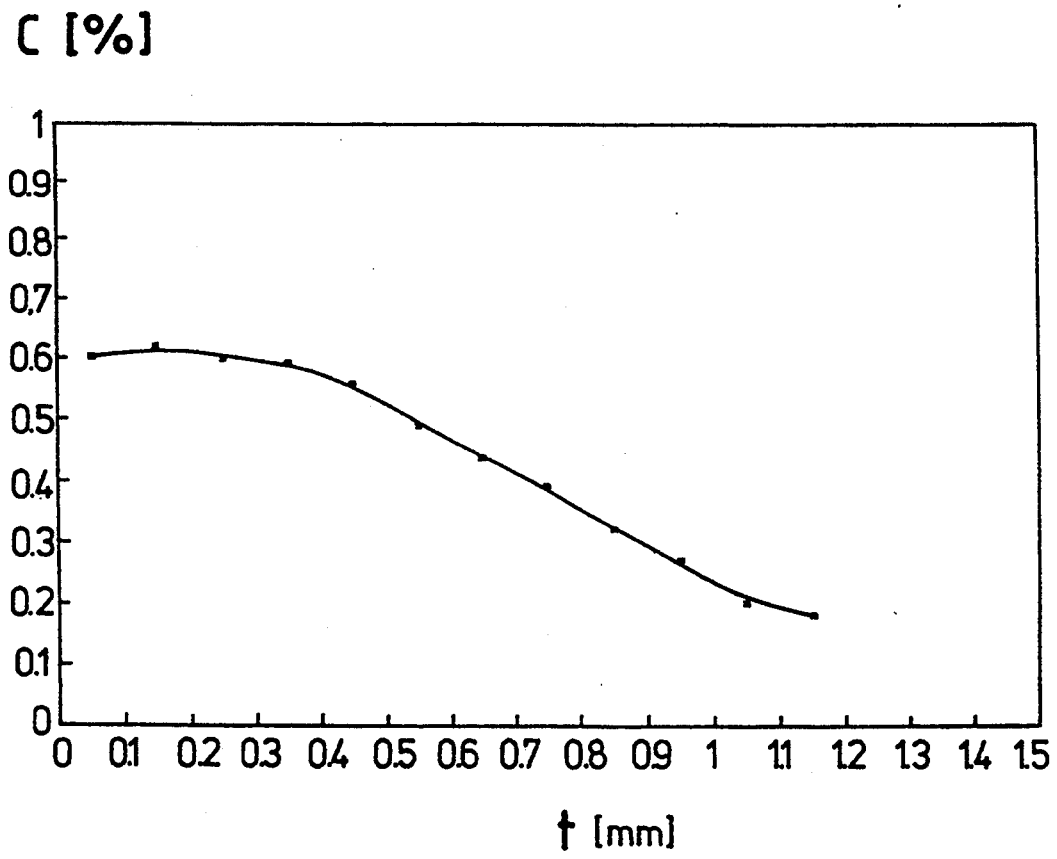
FIG. 4 is a diagram showing the variation of the carbon concentration in the depth of the workpiece starting from the surface.

Measurement of the pattern of the carbon content led to the diagram of FIG. 4. On the abscissas is recorded, as in FIG. 2, the depth in millimeters, starting from the surface, and on the ordinates the carbon content in weight-percent. The curve has the desired S-shape.

The hardness characteristic, also measured, starting from the surface and going to a depth of 0.4 mm, was 800 HV1 throughout. The hardened depth at 0.9 mm was 550 HV1. This corresponded fully to the requirements.

EXAMPLE 2

The experiment of Example 1 was repeated, but with the following changes:

The substrates were gears with a ratio of tooth height $h_z$ to tooth gap width $1l_o$ of 1.5, made of 16CrMo4 steel alloy. 16CrMo4 contains at the outset 0.18% C, 1.00% Cr, and 0.25% Mo. The treatment temperature was 925° C. at a total pressure of 2500 Pa. In the first carburization phase of 195 minutes the ratio of pulse time to pause time was 0.07, and in a second carburization phase of 70 minutes it was 0.04.

Figure 5:
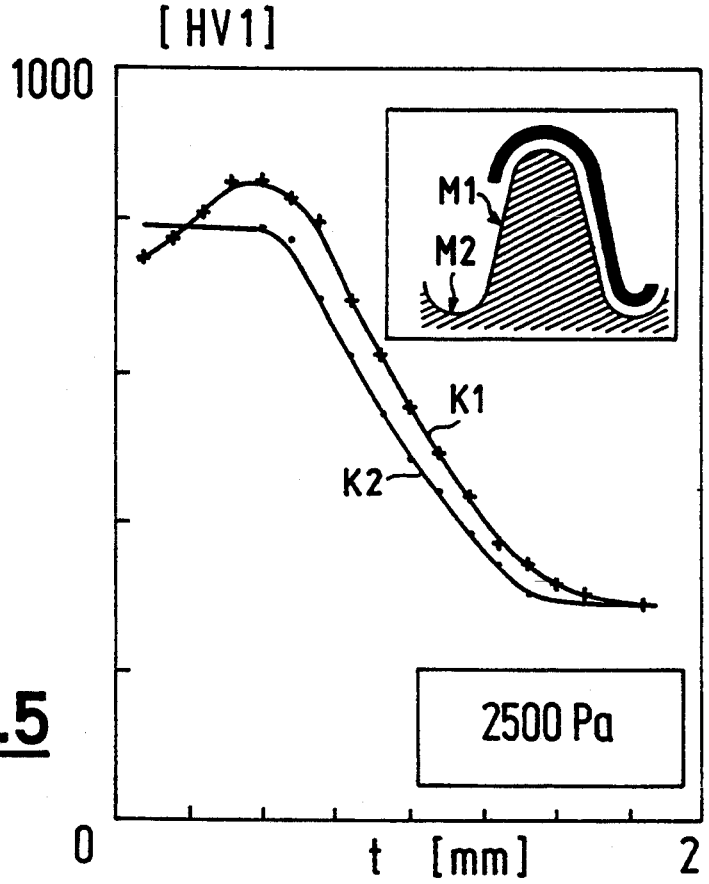
FIG. 5 is a diagram giving a comparative representation of the hardness curve at the flank and root of a gear tooth after using a process pressure of 2500 Pa.

The results of this experiment are represented in FIG. 5. At the top right in the window the tooth profile (hatched) and the so-called plasma fringe (thick, black line) are represented, and likewise the points of measurement M1 and M2. The plasma conforms extraordinarily well to the profile of the tooth. The point of measurement M1 is on the tooth's flank, and point of measurement M2 at the tooth's root. In the diagram the hardness "HV1" is represented over the depth "t." The curve K1 shows the hardness pattern at point M1 and curve K2 the hardness pattern at point M2. It is to be noted that the measurements agree quite well and that especially the depth of penetration "t" is essentially equal at M1 and M2, which is to be attributed to the good conformation of the plasma to the tooth's profile.

EXAMPLE 3 (for comparison purposes)

The experiment of Example 2 was repeated, the only difference being that the total pressure in the process chamber was reduced to 600 Pa.

Figure 6:
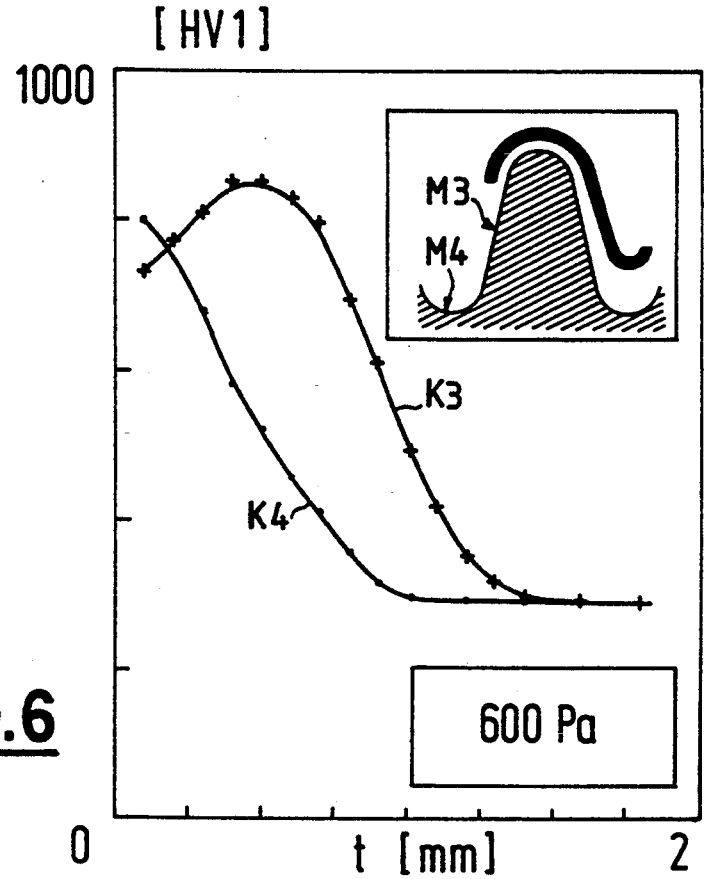
FIG. 6 is a diagram similar to FIG. 5, but after using a process pressure of only 600 Pa.

The results of this experiment are represented in FIG. 6. Here, again, in the window on the upper right are represented the (identical) tooth profile (hatched) and the so-called plasma fringe (thick, black line), and likewise the points of measurement M3 and M4. The plasma conforms well only to the top of the tooth, and at the root it is at a definitely greater distance from the tooth profile. Measurement point M3 is on the flank of the tooth, and point M4 at the root of the tooth. In the diagram the hardness "HV1" is represented over the depth "t." Curve K3 shows the hardness pattern at measurement point M3, and curve K4 the hardness pattern at point M4. It can be seen that the measurements are very different from one another, and that especially the depth of penetration "t" at M4 is definitely less than it is at M3, which is to be attributed to the poorer conformity of the plasma in the area of the root of the tooth profile.

This comparative experiment clearly shows that considerable importance is to be attributed to the total pressure in the process chamber.

We claim:

1. Process for hardening a workpiece of steel having an austenite region with a carbon saturation limit beyond which carbides are formed, said workpiece having a surface, said process comprising the following steps:
   - providing a cathode and an anode in a vacuum chamber,
   - placing said workpiece on said cathode, said cathode serving as a workpiece holder,
   - evacuating said chamber,
   - introducing a process gas into said chamber so that a total pressure of 14 to 30 mbar is present in the chamber, said process gas consisting of 2 to 50% by volume argon, 3 to 50% by volume gaseous hydrocarbons, and hydrogen,
   - generating a plasma discharge in said chamber by providing a pulsed voltage having pulses of between 200 and 2000 volts between said cathode and said anode, said pulses being separated by pauses, said voltage having an initial pulse time between 110 and 10,000 μs and an initial pause time between 30 and 10,000 μs, and
   - decreasing average power fed to said plasma discharge during said pulsed voltage by at least one of reducing said pulse time and lengthening said pause time wherein the carbon saturation limit of the steel in the austenite region is at no time exceeded on the surface of the workpiece.

2. Process as in claim 1 wherein said average power is initially only high enough to cause carburization at the surface of the workpieces without reaching said saturation limit.

3. Process as in claim 2 wherein average power is finally decrease to reduce the mass flow of carbon into the workpiece and to reduce carbon content at the surface of the workpiece.

4. Process as in claim 1 wherein said average power is decreased continuously by at least one of reducing each successive pulse time and lengthening each successive pause time.

5. Process as in claim 1 wherein said pulsed voltage is between 200 and 900 volts.

6. Process as in claim 5 wherein said pulsed voltage is between 500 and 700 volts.

7. Process as in claim 1 wherein said process gas is fed into said chamber while said plasma discharge is generated.

8. Process as in claim 1 wherein said process gas consists of 10 to 30% by volume argon, 10 to 30% by volume hydrocarbon, balance hydrogen.

9. Process as in claim 1 further comprising heating said workpiece by a heat source independent of the plasma.

10. Process as in claim 1 wherein said process gas consists of 15% argon, 5% methane, and 80% hydrogen.

11. Process as in claim 1 wherein said pulsed voltage has a ratio of pulse time to pause time between 0.3 and 0.02.

12. Process as in claim 11 wherein said ratio is decreased from 0.2 to 0.025 during said pulsed voltage.

* * * * *